US006840366B2

(12) United States Patent
Sheng-Hsing

(10) Patent No.: US 6,840,366 B2
(45) Date of Patent: Jan. 11, 2005

(54) COIN PROCESSING DEVICE

(75) Inventor: Chung Sheng-Hsing, Taipei (TW)

(73) Assignee: Comex Telecom Corporation, Taipei (TW)

( * ) Notice: Subject to any disclaimer, the term of this patent is extended or adjusted under 35 U.S.C. 154(b) by 163 days.

(21) Appl. No.: 10/183,482

(22) Filed: Jun. 28, 2002

(65) Prior Publication Data

US 2004/0000462 A1 Jan. 1, 2004

(51) Int. Cl.[7] ..... G07F 1/04
(52) U.S. Cl. ..... 194/347; 194/350; 193/DIG. 1
(58) Field of Search ..... 194/347, 229, 194/230, 302, 344, 345, 346, 350, 351; 193/DIG. 1

(56) References Cited

U.S. PATENT DOCUMENTS 4,899,371 A * 2/1990 Su ..... 379/146
5,494,146 A * 2/1996 Kurosawa et al. ..... 194/317
6,508,700 B2 * 1/2003 Mori et al. ..... 453/3
6,702,092 B2 * 3/2004 Nakajima et al. ..... 194/302
2002/0162725 A1 * 11/2002 Nakajima et al. ..... 194/302

FOREIGN PATENT DOCUMENTS

JP 4-172592 A * 6/1992 ..... G07F/9/00
JP 4-175895 A * 6/1992 ..... G07F/1/04
JP 4-186498 A * 7/1992 ..... G07F/9/00

* cited by examiner

*Primary Examiner*—Donald P. Walsh
*Assistant Examiner*—Mark J. Beauchaine
(74) *Attorney, Agent, or Firm*—Bacon & Thomas

(57) ABSTRACT

A coin processing device. The device includes coin tracks that are aligned side by side, such that the coin tracks and coin storages are arranged within a limited space.

6 Claims, 4 Drawing Sheets

COIN PROCESSING DEVICE

FIELD OF INVENTION

The present invention relates to a coin processing device, especially to a coin processing device with a plurality of coin slots.

BACKGROUND OF INVENTION

In all kinds of automatic vending machines, the coin processing device is an important component. Any one who wishes to purchase a product or service from the automatic vending machine or to obtain a certificate of payment, inserts a coin into the coin processing device and will be given the requested product, service or certificate, after the coin is sensed, identified and processed. Such an automatic vending machine may be used as a product vending machine, such as a cold drink vender, a service vending machine, such as a payphone, a game machine etc., or a ticket vending machine.

The functions as provided by a coin processing device include: coin sensing function, to identify whether an inserted coin is processable by the coin processing device; coin identification function, to identify the sort of an inserted coin; coin charging function, to charge the inserted coin to a temporary storage through decided path(s), and coin processing function, to process the inserted coin as required, including acceptance and rejection of the inserted coin. In general, a conventional coin processing device has all or a part of the above functions.

Because of the different size and material of coins that may be inserted into a coin processing device, coins being inserted shall be processed in different manners according to the size and material and other features of them. In order to conduct such processing, some problems need to be solved.

First of all, coins to be processed are stored in the temporary storages before they are processed as being accepted or rejected. The more sorts of coins the coin processing device can process, the more temporary storages will be needed. The temporary storages are provided as parts of or extensions to the coin tracks. Space occupied by the temporary storages is approximately in ratio to the number of the temporary storages. Besides the temporary storage, a coin track is necessary to be used as exit way of coins that the coin processing device is not able to process. This coin rejection track occupies a part of the space of the coin processing device. While it is always necessary to make the coin processing device as compact as possible, the space that can be used by the coin processing device is limited. Designers of the coin processing device have to face a dilemma: The coin processing device needs to be compact, while the sorts of coins to be processed need to as many as possible.

Taiwan utility model number 94587 (filing number 82213793) discloses an "improvement of coin track mechanism", wherein the mechanism has one single coin track, which has one fake coin exit way, one genuine coin storage, one coin acceptance exit way and one coin rejection exit way. Two stoppers are provided in the coin track. The first stopper is used to reject coins that are identified as fake coins and the second stopper is used as gate for the coin acceptance exit way. This coin track mechanism is able to process only one sort of coin.

Taiwan utility model No. 123142 (filing number 85217794) disclosed a coin collecting device invented by the same inventor. This device comprises in substance tow coin tracks aligned in parallel. The first coin track is used as exit track for coins that are identified as fake coins. The second coin track is used to store coins that are identified as genuine coins. Acceptance and rejection of coins are processed inside the second coin track. In this invention, a coin selection level is used to control the pathways of the fake coins and the genuine coins. Mechanical errors and malfunctions tend to happen, since the selection of the pathways is controlled by a level. This invention is able to process a single sort of coin.

It is thus necessary to provide a novel coin processing device that is able to process a plurality of sorts of coins with a compact device.

OBJECTIVES OF INVENTION

The objective of this invention is to provide a novel coin processing device that is able to process a plurality of sorts of coins.

Another objective of this invention is to provide a compact coin processing device that is able to process a plurality of sorts of coins.

SUMMARY OF INVENTION

According to this invention, a coin processing device is provided. The coin processing device of this invention comprises a plurality of coin tracks arranged in three dimension. The coin tracks of the coin processing device are aligned side by side, such that a plurality of coin tracks and coin storages are arranged within a limited space.

The coin processing device of this invention comprises:

a coin entry way, including an opening allowing coins to enter into the coin processing device;

a first coin track mechanism, provided in the downstream position to the coin entry way, to allow coins to be processed to pass and comprised a coin exit;

a second coin track mechanism, comprising a coin entry, a coin track to allow coins to pass, and a coin storage slot to store at least one coin temporarily;

a third coin track mechanism, comprising a coin entry, a coin track to allow coins to pass, and at least two coin storage slots to store at least one coin temporarily, respectively;

wherein entries of said second and third coin track mechanisms are aligned in parallel along the thickness direction of coins to be processed when the coins pass through said first coin track mechanism, at positions opposite to coin exit of said first coin track mechanism; and a coin track selection mechanism, positioned between exit of said first coin track mechanism and entries of said second and third coin track mechanisms, to guide coins released by said first coin track mechanism to enter the entry of one of said second and said third coin track mechanisms, according to a coin track selection instruction;

characterized in that said coin track selection mechanism comprises a wedge valve member actuated by an electric signal.

The above and other objectives and advantages of this invention may be clearly understood from the detailed description by referring to the following drawings.

DETAILED DESCRIPTION OF INVENTION

Figure 1:
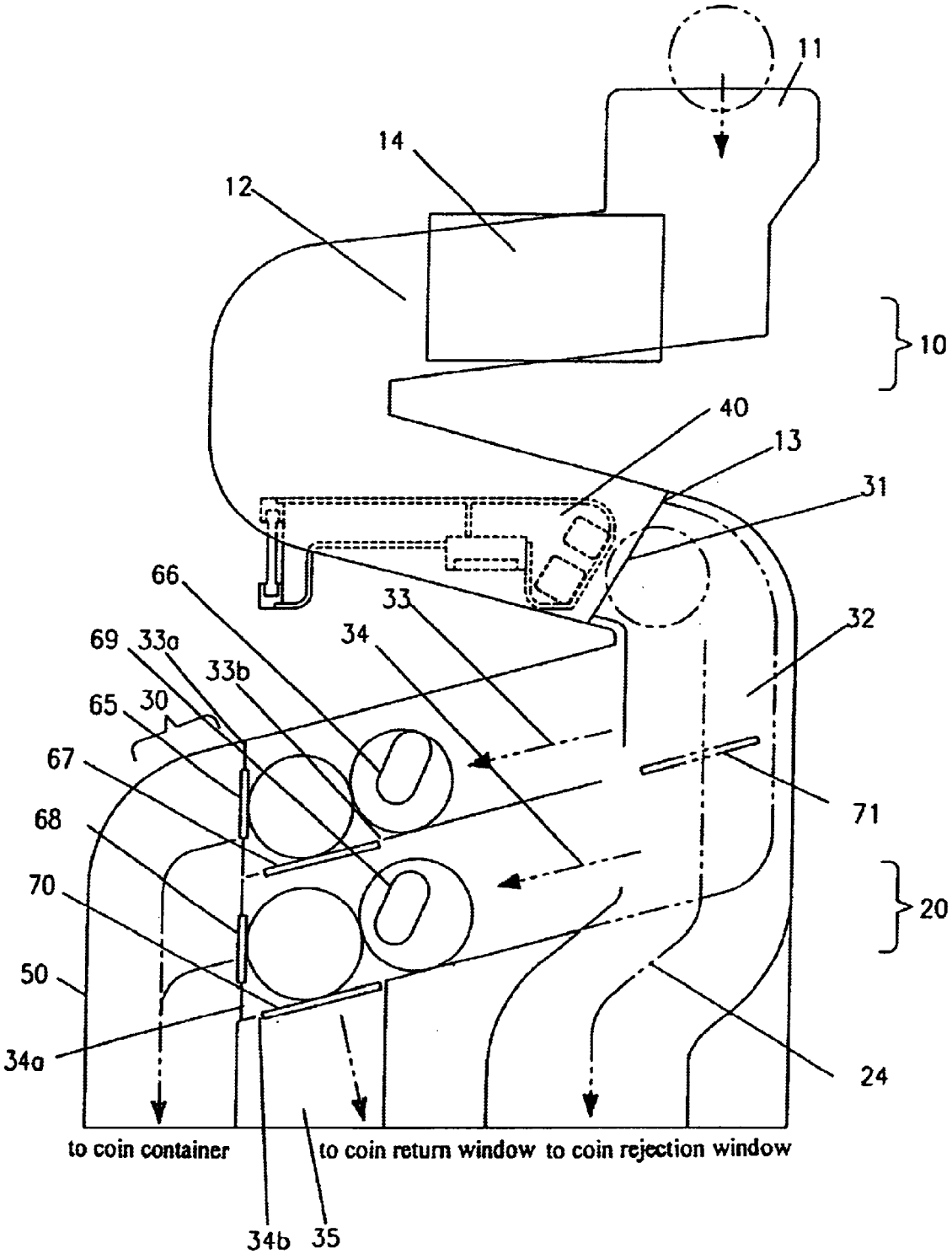
FIG. 1 illustrates the structural diagram of the coin processing device of this invention.
Figure 2:
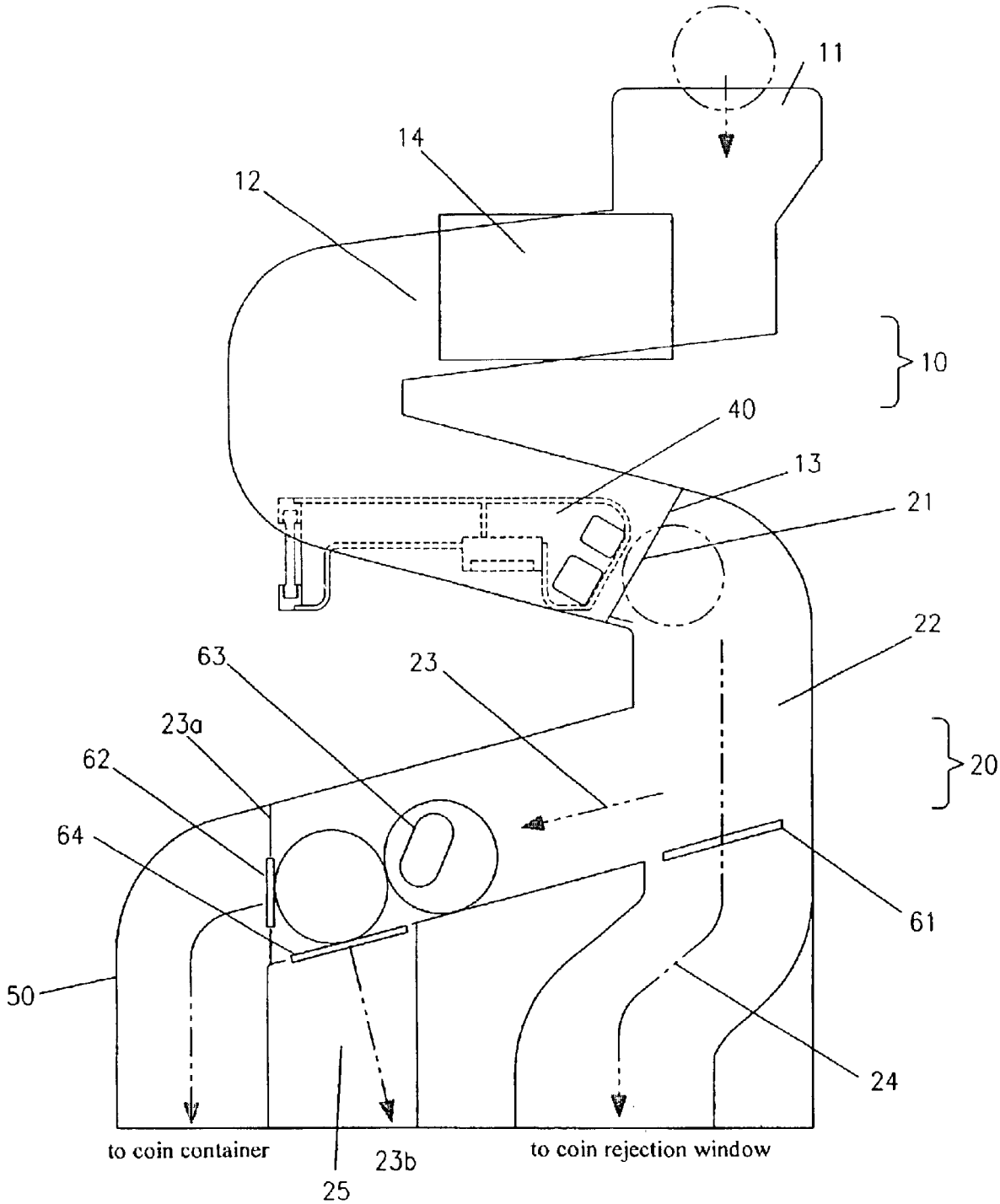
FIG. 2 illustrates the structure diagram of the first and second coin track mechanisms of the coin processing device of this invention.

The embodiment of the coin processing device of this invention will be described by referring to the drawings in the followings. FIG. 1 illustrates the structure diagram of the coin processing device of this invention. FIG. 2 illustrates the structure diagram of the first and second coin track mechanisms of the coin processing device of this invention. As shown in the figures, the coin processing device of this invention comprises a first coin track mechanism 10, a second coin track mechanism 20, a third coin track mechanism 30 and a coin selection mechanism 40 positioned at downstream to said first coin track mechanism 10 and upstream to said second coin track mechanism 20 and said third coin track mechanism 30.

Refer to FIG. 2. As shown in this figure, the first coin track mechanism 10 includes an opening 11 connected to the entrance of the coin processing device, allowing coins to be processed to enter into the coin processing device. The first coin track mechanism 10 also includes a long narrow coin track 12, with a width (measured along the diameter direction of coins to be processed) and a height (measured along the thickness direction of coins to be processed) slightly greater than that of the coins to be processed, such that coins to be processed may pass through it. An exit 13 is provided at the downstream site of the first coin track mechanism 10, whereby coins to be processed may exit the first coin track mechanism 10 from here.

The second coin track mechanism 20 also includes an opening 21 and a coin track 22. The arrangements of the opening 21 and the coin track 22 are similar to that of the first coin track mechanism 10. The coin track 22 of the second coin track mechanism 20 extends to a desired direction or to desired directions. A coin rejection track 24 is provided at the downstream part of the second coin track mechanism 20.

As shown in this FIG. 2, the coin rejection track 24 is a coin track extended downwards. A coin exit (not shown) may be provided at the bottom of the coin rejection track 24. In the embodiment of this invention, a first coin storage 23 is provided and extended from a side of the second coin track mechanism 20. The coin storage 23 is designed to temporarily store a plurality of coins to be processed. Preferably the coin storage 23 has a slope downwardly, so that incoming coins may move toward its exit 23*a* due to the gravity. A stopper valve 62 is provided at the exit 23*a* to stop the movement of the incoming coins towards the downstream direction of the coin storage 23. Preferably a stopper 63 is provided in the coin storage 23, at a upstream position relatively to the stopper valve 62, such that, when a plurality of coins are temporally stored in the coin storage 23, only one or a determined number of coins are allowed to pass the stopper valve 62, after the stopper valve 62 is opened. The stopper valve 62 may be a stopper plate and the stopper 63 may be a seesaw element interactive with the stopper valve 62. The stopper as disclosed in the aforesaid Taiwan utility model number 123142 provides the same or similar functions and may be taken for reference.

The first coin storage 23 and the coin rejection track 24 are the downstream parts of the second coin track mechanism 20. At the junction of the first coin storage 23 and the coin rejection track 24, a selection valve 61 is provided to guide the incoming coins to enter the first coin storage 23 or the coin rejection track 24. In practice, the selection valve 61 may be a stopper. When the selection valve 61 is closed, the incoming coins are introduced into the first coin storage 23. When the selection valve 61 is opened, the incoming coins enter into the coin rejection track 24. In the application of this invention, when an incoming coin is determined not one qualifying the processing of the coin processing device, the coin will be introduced into the coin rejection track 24 and will be rejected. Otherwise, the coin will be allowed to enter the first coin storage 23, waiting to be processed.

In the first coin storage 23, a coin return exit 23*b* is provided at a lower position adjacent to the coin exit 23*a*. The coin return exit 23*b* is closed by a stopper valve 64. The stopper valve 64 may be a stopper. When the stopper valve 64 is opened, the stored coins may drop downwardly into the first coin return track 25 connected to the coin return exit 23*b*. A coin return window (not shown) may be provided at the downstream position of the first coin return track 25.

In other embodiments of this invention, the first coin storage 23 is not provided in the second coin track mechanism 20.

Now refer to FIG. 1. As shown in this figure, the third coin track mechanism 30 has a structure similar to that of the second coin track mechanism 20, except that the third coin track mechanism 30 is not provided with the coin rejection track 24. In other words, the third coin track mechanism 30 has an opening 31 and a coin track 32. The arrangements of the opening 31 and the coin track 32 are similar to that of the first coin track mechanism 10 and the second coin track mechanism 20. The coin track 32 of the third coin track mechanism 30 extends to desired directions. A second coin storage 33 in a higher position and a third coin storage 34 in a lower position are provided at the downstream part of the third coin track mechanism 30. Each of the coin storages 33 and 34 are designed to temporarily store a plurality of coins to be processed. Preferably the coin storages 33 and 34 have a slope downwardly, so that incoming coins may move toward their exits 33*a* and 34*a* due to the gravity. Stopper valves 65 and 68 are provided at the exits 33*a* and 34*a*, respectively, to stop the movement of the incoming coins towards the downstream direction of the coin storages 33 and 34. Preferably a stopper 66, 69 is provided in each of the coin storages 33 and 34, at a upstream position relatively to the stopper valves 65 and 68, respectively, such that, when a plurality of coins are temporally stored in the coin storages 33 and/or 34, only one or a determined number of coins are allowed to pass the stopper valves 65 or 68, after the stopper valve 65 or 68 is opened. The structure and arrangement of the stopper valves 65, 68 and the stoppers 66, 69 are similar to that of the second coin track mechanism.

The second coin storage 33 and the third coin storage 34 are the downstream parts of the third coin track mechanism 30. At the junction of the second coin storage 33 and the third coin storage 34, a selection valve 71 is provided to guide the incoming coins to enter the second coin storage 33 or the third coin storage 34. In practice, the selection valve 71 may be a stopper. When the selection valve 71 is closed, the incoming coins are introduced into the second coin storage 33. When the selection valve 71 is opened, the incoming coins enter into the third coin storage 34.

In the second coin storage 33 and the third coin storage 34, coin return exits 33*b*, 34*b* are respectively provided at a lower position adjacent to the coin exits 33*a*, 34*a*. The coin return exits 33*b*, 34*b* are closed respectively by stopper valves 67, 70. The stopper valves 67, 70 may be stoppers. In the embodiment of this invention, the stopper valves 67 and 70 are interactive and the stopper valve 67 functions as border or divider of the second coin storage 33 and the third coin storage 34. As a result, when the stopper valves 67 and 70 are both opened, the stored coins may drop downwardly into the second coin return track 35 connected to the coin return exits 33*b*, 34*b*. A coin return window (not shown) may be provided at the downstream position of the second coin return track 35.

In another embodiment of this invention, the third coin track mechanism 30 has only one coin storage.

The opening 21 of the second coin track mechanism 20 and the opening 31 of the third coin track mechanism 30 function as entrances of the coin track mechanisms 20, 30, respectively. Both are flat, allowing a coin to pass through, and face the same direction towards the exit 13 of the first coin track mechanism 10. A coin selection mechanism 40 is provided between the exit 13 of the first coin track mechanism 10 and the openings 21, 31 of the second and third coin track mechanisms 20, 30. The major purpose of the coin selection mechanism 40 is to charge the coin that exits the exit 13 of the first coin track mechanism 10 to enter either one of the openings 21 and 31, in response to a coin track selection signal.

Figure 3:
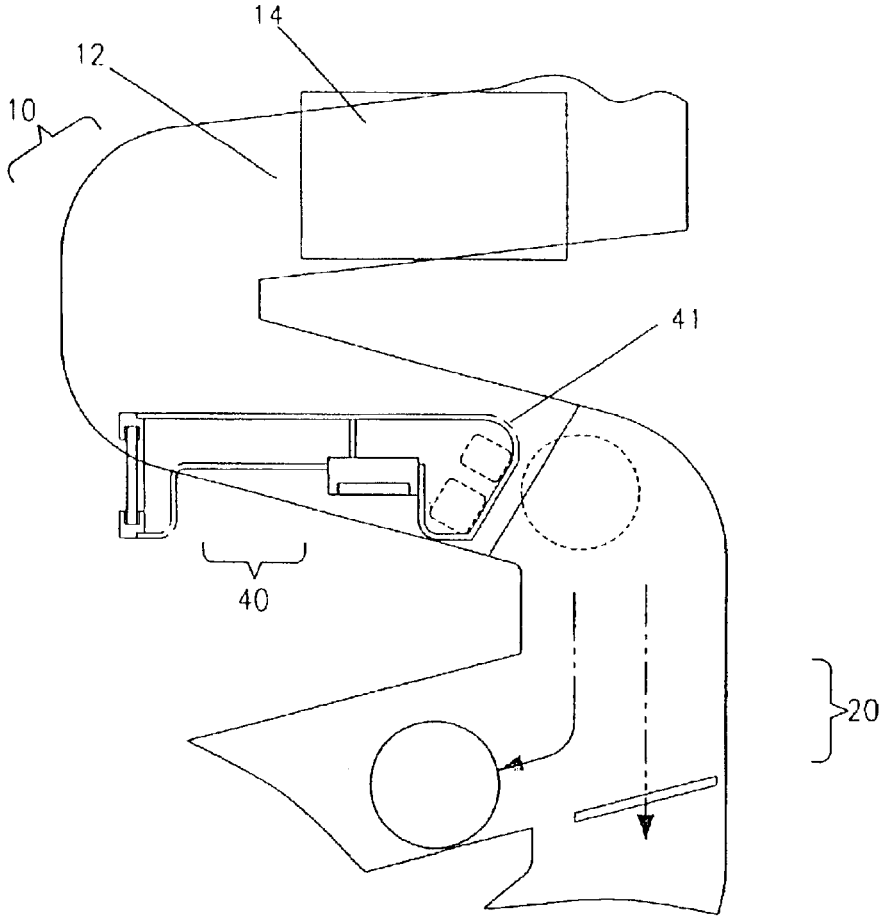
FIG. 3 illustrates the structure of the coin selection mechanism of the coin processing device of this invention.

FIG. 3 illustrates the structure of a coin selection mechanism suited in the coin processing device of this invention. As shown in the figure, the coin selection mechanism 40 comprises a ledge valve member 41 and its actuation mechanism.

Figure 4A:
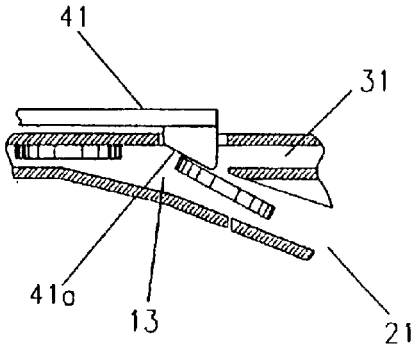
FIGS. 4(*a*) and 4(*b*) show the operation of the coin selection mechanism.
Figure 4B:
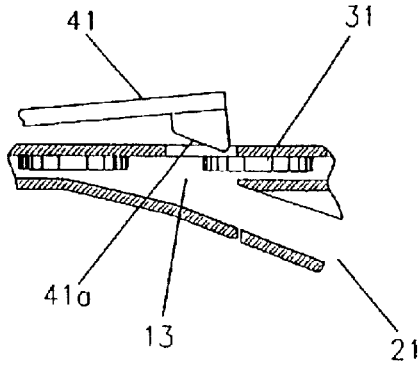

Now the operation of the coin selection mechanism 40 will be described. FIGS. 4(*a*) and 4(*b*) show the operation of the coin selection mechanism 40. In the embodiment of this invention, the wedge valve member 41 of the coin track selection mechanism 40 is engaged with the first coin track mechanism 10 and its thicker end is extruded from the inner surface of the coin track 12, as a normal position, as shown in FIG. 4(*a*). At this position, coins passing by said wedge valve member 41 will be guided to enter the entrance 21 of the second coin track mechanism 20. The actuator 42 of the wedge valve member 41 is controlled by a controller (not shown), which is connected to a sensor 14 provided at the first coin track mechanism 10. The sensor 14 is used to sense incoming matters that enters into the first coin track mechanism 10, in order to determine whether the incoming matters are coins to be stored in the coin storages 23, 33 and 34. If an incoming matter is determined not belonging to any sort of coin to be processed, the incoming matter will be treated as a "fake coin". When the incoming matter is determined as a fake coin, the wedge valve member 41 is not actuated, such that the fake coin will enter into the second coin track mechanism 20. At this time, the selection valve 61 is at its extrusion position, whereby the fake coin will be introduced into the first coin storage 23. For this reason, the controller (not shown) actuates the selection valve 61, allowing the fake coin to pass by the selection valve 61 and enter into the coin rejection track 24 and to the coin rejection window (not shown). Of course, if no first coin storage 23 is provided in the second coin track mechanism 20, no selection valve 61 will be needed.

On the other hand, if the incoming matter is determined as one of the sorts of coins to be processed, actuation of the wedge valve member 41 will be determined according to the sort of the incoming coin. If the coin belongs to the sort of coin to be stored in the first coin storage 23, the wedge valve member 41 is not actuated, such that the incoming coin will enter the second coin track mechanism 20 and be guided into the first coin storage 23. If the incoming coin is a coin to be stored in the second coin storage 33 or the third coin storage 34, the wedge valve member 41 will be actuated, such that it is not extruded from the inner surface of the first coin track 12, as shown in FIG. 4(*b*). As a result, the incoming coin will be introduced into the third coin track mechanism 30, and then to the second coin storage 33 or the third coin storage 34, with the guidance of the selection valve 71, which is controlled by the controller (not shown).

The wedge valve member 41 of the coin selection mechanism 40 has a smooth surface 41*a*, allowing coins passing through it to slide to the entrance 21 of the second coin track mechanism 20 or the entrance 31 of the third coin track mechanism 30, due to the force of the gravity. In some embodiments of this invention, a wedge valve member with a curved surface is provided to obtain same or similar effects. By using the wedge valve member 41, it is not necessary to use a swing valve or a coin track selection track to guide the path of the incoming coins, as did in the conventional art. Efficiency in the selection of the desired coin track is thus enhanced and mechanical errors in exercising the selection are thus reduced.

As to the determination of the nature of the foreign matter according to the sensing results of the sensor 14, it may be conducted by any computer program that is know to those skilled in the art. The coin sensing device as disclosed in the aforesaid Taiwan utility model number 123142 may also be taken for reference. Detailed description thereof is thus omitted.

In addition, if more than two coin track mechanisms are used in the coin processing device, all the entrances of the coin track mechanisms are aligned in parallel at the opposite position to the exit of the first coin track mechanism. In such an arrangement, the wedge valve member of this invention may be used to guide the incoming coins to enter one of the coin track mechanisms in a correct and efficient manner.

As shown in FIGS. 1 and 2, at the downstream position of the exit 23*a* of the first coin storage 23 and the exits 33*a*, 34*a* of the second and third coin storages 33, 34, provided is a coin acceptance chamber 50. The coin acceptance chamber 50 is a space or chamber with any shape that allows coins exiting the exits 23*a*, 33*a* and 34*a* to enter into it. Coins entering into the coin acceptance track 50 may drop into the coin container (not shown) connected to the coin acceptance chamber 50.

In controlling the selection of the path of the coin, the stopper valve 62 at the exit 23*a* of the first coin storage 23, the stopper valve 65 at the exit 33*a* of the second coin storage 33 or the stopper valve 68 at the exit 34*a* of the third coin storage 34 may open, in response to a control signal generated by the controller (not shown). As a result, coin(s) located at the upstream position of the opened stopper valve 62, 65 or 68 will drop into the coin acceptance chamber 50. At the same time the stopper 63, 66 or 69 adjacent to the opened stopper valve may interact with the opened stopper to stop coins following the selected coin(s) to move downstream. As a result, only one or other determined number of coins are allowed to enter the coin acceptance chamber 50. When the opened stopper valve 62, 65 or 68 is closed again, the stopper 63, 66 or 69 adjacent to it will move back to its normal position, whereby coins stopped by the stopper 63, 66 or 69 are allowed to move towards the stopper valve 62, 65 or 68, until another coin acceptance signal is generated.

When a coin return signal is generated by the controller (not shown), the stopper valve 64, 67 and/or 70 at the coin return exit 23*b*, 33*b* and/or 34*b* is opened. With the operations of the stopper 63, 66 and/or 69, coins temporarily stored in the fist, second and/or third coin storage 23, 33 and/or 34 will drop into the first coin return track 25 and/or the second coin return track 35. In order to return the coins in one step, it is preferable that the first coin return track 25 and the second coin return track 35 are not positioned on the same or overlapping plane.

When a plurality of coin track mechanisms are provided, the structure and control of the additional coin track mechanisms are similar to that of the third coin track mechanism 30. Detailed description thereof is thus omitted.

Figure 5:
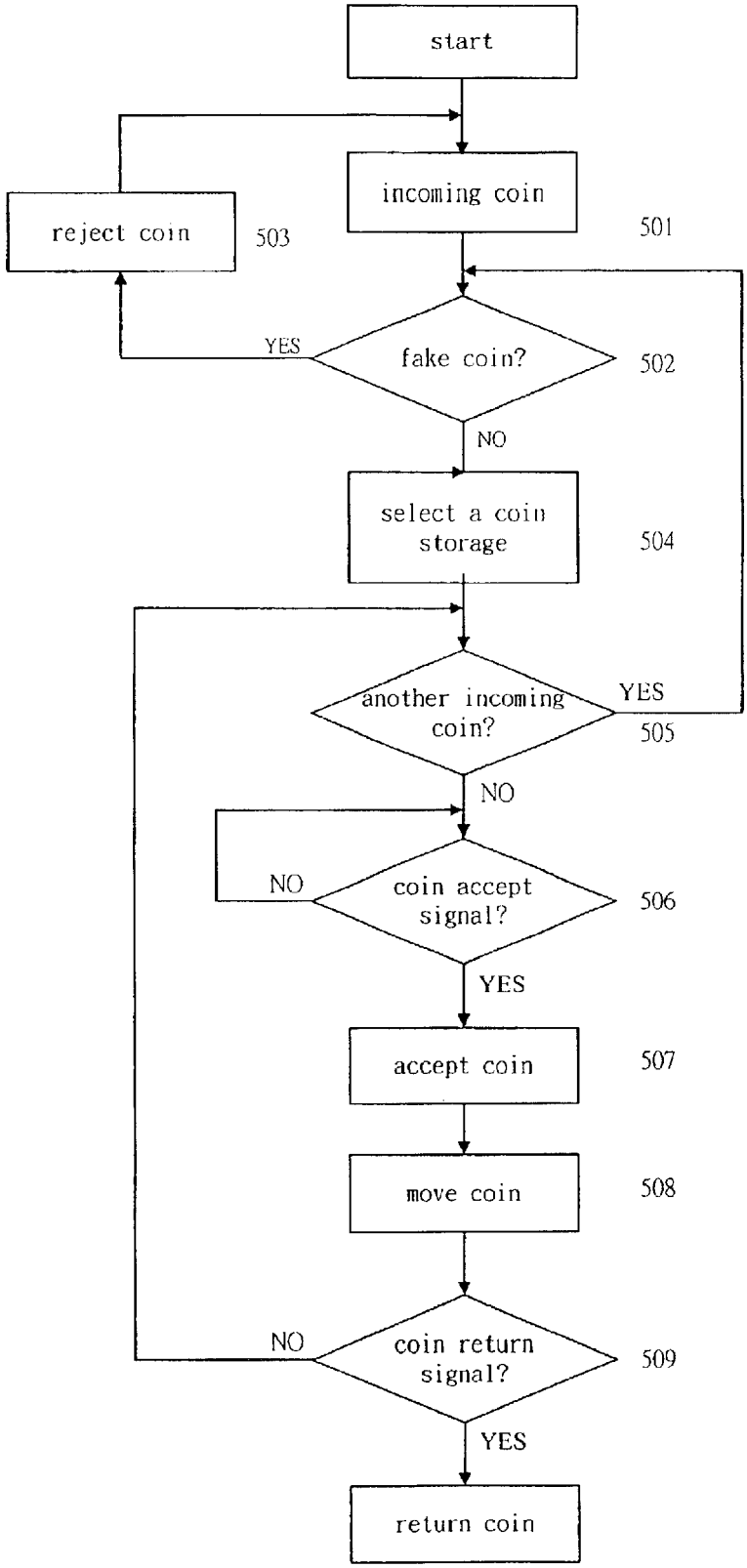
FIG. 5 shows the flow chart of the coin processing of the coin processing device of this invention.

The processing of coins using the coin processing device of this invention will be described in the followings. FIG. 5 shows the flow chart of coin processing using the coin processing device of this invention. As shown in the figure, at 501 a coin entering into the first coin track mechanism 10 is sensed and the coin processing flow of this invention is actuated. Signal to actuate the operation of the coin processing device may also be a signal generated by a bottom pushed by the user, a signal generated when the handset is removed from the hook or any other signals. At 502 the coin sensor 14 determines whether the incoming matter is a coin to be processed by the coin processing device, and the sort of the coin. If the incoming matter is determined as a fake coin, the incoming matter is rejected at 503, by actuating only the wedge valve member 41. If the incoming matter is determined a coin to be processed, the coin is allowed to enter a determined coin storage 23, 33 or 34 according to its nature, by controlling at 504 the operations of the wedge valve member 41, the stopper valves 61 and/or 71. At 505 the controller determines whether another incoming matter has entered into the first coin track mechanism 10. If yes, the operation returns to step 502; Otherwise the controller determines whether a coin acceptance signal is generated at 506. If not, the operation returns to step 506, otherwise, a selected con acceptance stopper 62, 65 or 68 is actuated at 507 to accept one or a determined number of coins. At 508, the coins following the accepted coin or coins are moved towards the exit 23*a*, 33*a* or 34*a* relating to the accepted coin. At 509, the controller determines whether a coin return signal is generated. If no, the operation returns to step 505, otherwise the coins stored in the coin storages 23, 33 and 34 are returned by opening the stoppers valves 64, 67 and 70 at 510.

EFFECTS OF INVENTION

As described above, in the coin processing device of this invention, a wedge valve member 41 is provided. Coins are guided to enter into a selected coin track according to the position of the wedge valve member 41. It is not necessary to provide a swing valve or a coin selection track to conduct the selection of suited coin tracks. High efficiency in the selection of coin tracks is thus obtained.

In addition, in the present invention number of coin track mechanisms that may be provided in the coin processing device is not limited to two. It is possible to align more than two coin track mechanisms at the opposite position of the exit of the first coin track mechanism and to charge the incoming coins into selected coin tracks correctly by using the coin track selection mechanism 40 of this invention.

As the present invention has been shown and described with reference to preferred embodiments thereof, those skilled in the art will recognize that the above and other changes may be made therein without departing form the spirit and scope of the invention.

What is claimed is:

1. A coin processing device, comprising:

a first coin track mechanism comprising a first coin track to channel coins to be processed and a coin sensor to determine whether an incoming foreign matter is a coin to be processed or not;

a second coin track mechanism comprising a second coin track, extended to form a coin rejection track and a first coin storage to store coins to be processed, and a selection valve to guide incoming foreign matters to enter said coin rejection track or said first coin storage;

a third coin track mechanism comprising a coin track, extended to form at least one second coin storage to store coins to be processed;

a coin selection valve, positioned between an exit of said first coin track mechanism and entrances of said second coin track mechanism and said third coin track mechanism, to guide incoming foreign matter exiting from said first coin track mechanism to enter said second coin track mechanism or said third coin track mechanism;

the entrances of said second coin track mechanism and said third coin track mechanism are aligned at a position opposite to the exit of said first coin track mechanism;

said coin selection valve comprises a wedged actuable valve, such that an incoming foreign matter may be guided to enter said second coin track mechanism or said third coin track mechanism according to the position of said wedged actuable valve; and a controller configured to control the operation of said wedged actuable valve and said selection valve of said second coin track mechanism.

2. The coin processing device according to claim 1, wherein said coin track of said third coin track mechanism further extends to form a third coin storage to store coins to be processed and where said third coin track mechanism comprises a selection valve to guide incoming foreign matters to enter said second coin storage or said third coin storage; and wherein said controller controls said selection valve of said third coin.

3. The coin processing device according to claim 1 or 2, wherein said coin tracks and said coin storages of said first, second and third coin track mechanisms respectively have a base declining downwards to the downstream of the movement of the foreign matters.

4. The coin processing device according to claim 1 or 2, wherein said coin storages respectively comprise a coin acceptance valve and a coin return valve.

5. The coin processing device according to claim 4, wherein said coin storages further comprise a coin stopper valve respectively to control quantity of coins passing through said coin stopper valve.

6. The coin processing device according to claim 2, wherein said second coin storage and said third coin storage are aligned one over another and wherein said coin return valve of said higher positioned coin storage divides said higher positioned coin storage and said lower positioned coin storage.

* * * * *